US011396417B2

(12) United States Patent
Giampuzzi et al.

(10) Patent No.: US 11,396,417 B2
(45) Date of Patent: Jul. 26, 2022

(54) SYSTEM AND METHOD FOR DISPENSING LIQUIDS

(71) Applicant: Voyager Products Inc., Toronto (CA)

(72) Inventors: Paolo Anton Giampuzzi, Mississauga (CA); Elad Barak, Toronto (CA)

(73) Assignee: VOYAGER PRODUCTS INC., Toronto (CA)

( * ) Notice: Subject to any disclaimer, the term of this patent is extended or adjusted under 35 U.S.C. 154(b) by 183 days.

(21) Appl. No.: 16/943,045

(22) Filed: Jul. 30, 2020

(65) Prior Publication Data

US 2021/0032088 A1 Feb. 4, 2021

Related U.S. Application Data

(60) Provisional application No. 63/035,539, filed on Jun. 5, 2020, provisional application No. 62/880,230, filed on Jul. 30, 2019.

(51) Int. Cl.
*B65D 83/00* (2006.01)
*A61J 7/00* (2006.01)

(52) U.S. Cl.
CPC ..... *B65D 83/0094* (2013.01); *A61J 7/0053* (2013.01)

(58) Field of Classification Search
CPC .... A61J 2200/70; A61J 7/0053; A61J 7/0418; A61J 7/0445; A61J 7/0084; A61M 1/1609; A61M 1/1645; A61M 1/166; A61M 1/1692; A61M 1/1696; A61M 1/3639; A61M 1/3641; A61M 1/3646;
(Continued)

(56) References Cited

U.S. PATENT DOCUMENTS 5,653,227 A * 8/1997 Barnes ..... A61M 15/0005 128/200.16
7,677,412 B2 3/2010 Litterst et al.
(Continued)

FOREIGN PATENT DOCUMENTS

CA 3059311 A1 7/2009
DE 102006043637 A1 * 11/2007 ..... A61M 11/006
(Continued)

OTHER PUBLICATIONS

Voyager Products expecting to bring its cannabis-infused pod to market in 3Q 2020; https://www.youtube.com/watch?v=yPgGwHdtC3w; [Retrieved from the Internet Oct. 8, 2020]. Published Nov. 5, 2019.
(Continued)

*Primary Examiner* — Vishal Pancholi
*Assistant Examiner* — Michael J. Melaragno
(74) *Attorney, Agent, or Firm* — Voz Patents, LLC

(57) ABSTRACT

The present invention is directed to a dispensing system, device, and method for the dispensing of a fluid supplement such as in the form of a concentrated fluid containing flavoring, nutrients, medication, and/or other supplements. Certain embodiments of the invention as disclosed herein comprise a handheld apparatus which allows the dispensing of predetermined amount of a fluid with single-handed use. Certain embodiments include self-contained pods which is controlled by a removable dispenser to allow for multiple types of fluids, and preventing cross-contamination within the dispenser.

25 Claims, 13 Drawing Sheets

(58) Field of Classification Search

CPC ..... A61M 1/3656; A61M 2205/126; A61M 2205/13; A61M 2205/14; A61M 2205/15; A61M 2205/3368; A61M 2205/3393; A61M 2205/3553; A61M 2205/3584; A61M 1/3626; A61M 2205/18; A61M 2205/3317; A61M 2205/3334; A61M 2205/3375; A61M 2205/502; A61M 2205/52; A61M 1/1643; A61M 1/3406; A61M 1/3413; A61M 1/3672; A61M 1/369; A61M 2205/10; A61M 2205/3306; A61M 2205/50; A61M 2205/584; A61M 2205/6072; A61M 2209/084; A61M 1/16; A61M 2205/3324; A61M 2205/3331; A61M 2205/505; A61M 1/1694; A61M 1/3434; A61M 1/3437; A61M 1/3441; A61M 1/3451; A61M 1/3458; A61M 2205/3653; A61M 5/14232; F04B 43/1284; B67D 1/0022; B67D 1/0079; B67D 1/0878; B67D 1/0888; B67D 1/1277; B65D 83/0094

USPC ..... 128/200.16; 222/206, 422; 422/502

See application file for complete search history.

(56) References Cited

U.S. PATENT DOCUMENTS 8,414,563 B2 * 4/2013 Kamen ..... A61M 5/14244 604/257
8,584,673 B2 * 11/2013 Thoemmes ..... A61M 15/0048 128/200.14
9,937,303 B1 * 4/2018 Yeates ..... A61M 15/0086
2003/0178024 A1 * 9/2003 Allan ..... A61M 11/003 128/200.24
2007/0000337 A1 * 1/2007 Gross ..... G01N 7/04 73/864.34
2007/0186923 A1 * 8/2007 Poutiatine ..... A61J 7/0038 128/200.14
2008/0163695 A1 * 7/2008 Ichikawa ..... G01L 9/0055 73/721
2009/0194562 A1 * 8/2009 Kessler ..... E03D 9/005 222/63
2010/0132748 A1 * 6/2010 Kessler ..... D06F 39/024 68/17 R
2012/0085344 A1 * 4/2012 Luber ..... A61M 15/0085 128/203.29
2012/0218333 A1 * 8/2012 Nishikawa ..... B41J 2/155 347/10
2013/0085460 A1 * 4/2013 Voss ..... A61F 9/0008 604/290
2013/0172831 A1 * 7/2013 Voss ..... A61M 11/008 604/298
2013/0255404 A1 * 10/2013 Mohr ..... B01L 3/021 73/864.01
2015/0136158 A1 * 5/2015 Stevens ..... A61M 15/06 131/329
2015/0150803 A1 * 6/2015 Boucher ..... A61K 45/06 128/200.23
2015/0151857 A1 * 6/2015 Lanigan ..... B65B 3/003 141/18
2015/0157053 A1 * 6/2015 Mayor ..... A24F 40/485 131/329
2015/0245654 A1 * 9/2015 Memari ..... H02J 50/10 141/2
2015/0247786 A1 * 9/2015 Parker ..... F22B 3/02 250/288
2015/0294551 A1 * 10/2015 Edwards ..... G09B 9/00 340/635
2015/0305974 A1 * 10/2015 Ehrenreich ..... A61B 5/6833 601/46
2016/0213065 A1 * 7/2016 Wensley ..... A24F 40/48
2017/0233114 A1 * 8/2017 Christensen ..... B65B 3/14 141/2
2017/0245552 A1 8/2017 Reevell
2018/0038357 A1 * 2/2018 Demers ..... F04B 45/0536
2018/0177325 A1 * 6/2018 Lyons ..... A47J 31/401
2019/0105619 A1 4/2019 Wilson et al.
2019/0307170 A1 * 10/2019 Zarifian ..... G05B 19/0426
2020/0022416 A1 * 1/2020 Alarcon ..... G16H 50/20
2020/0061337 A1 * 2/2020 Singh ..... A61M 25/007
2020/0061362 A1 * 2/2020 Singh ..... H05B 45/60
2020/0113787 A1 * 4/2020 Sirdeshmukh ..... G06F 21/6218
2020/0114087 A1 * 4/2020 Bauer ..... A61M 5/31593
2020/0163389 A1 * 5/2020 Sur ..... A61M 11/042
2020/0214625 A1 * 7/2020 Hooven ..... A61M 5/31
2020/0367553 A1 * 11/2020 Hejazi ..... A61M 11/005
2021/0023315 A1 * 1/2021 Goldenberg ..... A61M 15/06
2021/0023585 A1 * 1/2021 Fliess ..... B05B 1/083
2021/0052007 A1 * 2/2021 Mabee ..... A24F 40/48
2021/0052013 A1 * 2/2021 Mabee ..... F04B 37/14
2021/0170095 A1 * 6/2021 Diperna ..... A61M 5/142
2021/0354168 A1 * 11/2021 Fliess ..... B05C 5/001

FOREIGN PATENT DOCUMENTS

WO 2007092618 A3 12/2007
WO 2015112750 A1 7/2015

OTHER PUBLICATIONS

International Search Report dated Jan. 6, 2021 issued in PCT/IB2020/000650.
Written Opinion dated Jan. 6, 2021 issued in PCT/IB2020/000650.

* cited by examiner

SYSTEM AND METHOD FOR DISPENSING LIQUIDS

CROSS REFERENCE TO RELATED APPLICATIONS

This application claims benefit to U.S. Provisional Patent Application No. 62/880,230, entitled "SYSTEM AND METHOD FOR DISPENSING LIQUIDS", filed Jul. 30, 2019; and U.S. Provisional Patent Application No. 63/035,539 entitled "SYSTEM AND METHOD FOR DISPENSING LIQUIDS", filed on Jun. 5, 2020, which are incorporated by reference in their entireties for all purposes.

FIELD OF THE INVENTION

The present invention is directed to a dispensing device, system, and method for the dispensing of a fluid supplement. The dispensing of fluids, such as in the form of a concentrated fluid containing flavoring, nutrients, medication, and/or other supplements. The system as provided in certain embodiments, comprises a handheld apparatus which allows the dispensing of predetermined amount of a fluid with single-handed use.

BACKGROUND OF THE INVENTION

The use of concentrates for the addition of a supplement is a common method of administering supplements—such as vitamins, medication, and electrolytes. Particularly in the field of administering medication, the practice of using fluids has been adopted for ease of use, for those that have difficulty swallowing, as well as those that simply prefer to administer their supplements in fluid form to imbibe with a beverage. Recently the use of *Cannabis*-based medications and treatments have increased in use, however the traditional means of ingesting *Cannabis*-based medications including compounds such as tetrahydrocannabinol (THC) or cannabidiol (CBD) may be impractical, socially unacceptable, inappropriate, or undesirable.

A traditional means of ingesting or administering *Cannabis*-based medications is the inhalation of smoke generated through the burning of portions of the *Cannabis* plant. This method is imprecise with regard to the dosage to an individual and is increasingly discouraged in public settings. Furthermore, the inhalation of smoke are not recommended for certain users—such as children, the elderly, and those who are in a state of respiratory compromise—who may benefit from the use of *Cannabis* derived compounds. For instance, *Cannabis* derived compounds are used frequently for patients undergoing chemotherapy in efforts to stimulate hunger. Furthermore, in the medical community, there have been clinical findings which indicate that the use of CBD assists in the treatment and reduction of seizures in children suffering from severe forms of epilepsy such as Lennox-Gastaut syndrome and Dravet Syndrome.

Another popular means for the ingesting of *Cannabis*-based compound surrounds the act of "vaping," which operate on a similar basis as electronic cigarettes. Vaping surrounds the vaporization of a fluid within which the *Cannabis* compound is contained. Pulmonary health concerns exist surrounding the act of vaping as vaping has shown in some clinical trials to result in inflammation of the lungs and lung damage. In some cases, vaping has been attributed as a cause of death in some individuals. A further risk associated with vaping surrounds the dosage. The dose amount when vaping is heavily dependent upon a user and the amount they inhale.

A more recent means of ingesting or administering *Cannabis*-based medications is the oral ingestion of prepared edible portions which are prepared in a form such as cookies, gummy candies, or other edible forms. This method, although more precise and less likely to create corresponding health-risks, is still imprecise and is unable to be personalized for a specific user to provide appropriate dosage, track dosage, and to prevent over-dosage. Furthermore, mistakenly ingesting such edibles may create unsafe situation such as overdosing which results in an undesirable psychological state, particularly with children.

For reasons such as those discussed above, there is a need for a apparatus and method for the administration of *Cannabis*-based supplements in a precise, safe, and discrete manner.

SUMMARY OF THE INVENTION

It is an aspect of the present invention to provide a device and method for the accurate and precise dispensing of a fluid. The present invention surrounds the use of a dispenser unit which interconnects with interchangeable pods for the purposes of dispensing different fluids. The dispenser unit reads and records unique identifying information from the pod by reading a unique identifier or using a digital key to gain access to the dispenser function. The identifying information includes, but is not limited to minimum dosage, maximum dosage, potency, viscosity, electric requirements for pod operation, remaining fluid in the pod, recommended intervals for dosing, and predefined dose.

The interchangeability of pods with the dispenser allows a user to easily change the fluid, which is dispensed by the device, thereby negating the need to completely exhaust a first pod prior to using a second pod, and allowing a user to dispense different fluids without the need to carry multiple devices. Rather a user may carry a single dispenser and a plurality of pods which are configured to interconnect with the dispenser.

It is an aspect of the present invention to prevent accidental or unauthorized dispensing of fluid from a pod of certain embodiments. A combination of one-way valves, and anti-suction elements prevent the leakage of fluid from a pod. A one-way valve intended for filling the pod for instance, allows the filling of a reservoir from an external aspect of the pod, but does not allow flow of the liquid in the opposite direction.

Furthermore, a one-way valve intended for dispensing a fluid in certain embodiments for instance, allows flow of fluid from the pod to an external aspect of the pod further. The one-way valve further comprises an anti-suction feature. For instance, certain embodiments comprise an anti-suction channel connecting the external aspect of the one-way valve to an aspect of the pod wherein a user is unable to place their mouth over the one-way valve to suck the fluid from the pod. Sucking on the dispensing region of a pod would only result in drawing air from an external aspect of the pod located away from the one-way valve.

Many portable devices for the ingesting of a fluid, such as vape pens and electronic cigarettes, rely on the user to draw in the fluid with their breath. This mode of delivery is imprecise and unreliable.

It is an aspect of the present invention to provide a repeatable, reliable, and precise means for dispensing a fluid for ingestion. A dispenser and pod of certain embodiments allows the repeatable delivery of a predetermined amount. Furthermore, the dispenser tracks the amount dispensed, time of dispensing, and type of fluid dispensed.

It is a further aspect of the present invention that a dispenser interconnects with disposable or reusable pods wherein the fluid is contained. The pods have a self-contained dispensing mechanism actuated by the dispenser. Thus, the dispenser does not have direct contact with fluid and does not require cleaning. Furthermore, the lack of direct contact of fluid with the dispenser prevents cross-contamination of fluids when changing pods.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

BRIEF DESCRIPTION OF THE DRAWINGS

FIG. 2B—A perspective exploded view of a device for dispensing fluids comprising a dispenser and a removably interconnected pod.

FIG. 4B—A front cross-sectional view of a device for dispensing fluids comprising a pod.

FIG. 5B—A side cross-sectional view of a device for dispensing fluids comprising a pod.

FIG. 6B—A side cross-sectional view of a device for dispensing fluids comprising a pod in an ejection stroke configuration.

DETAILED DESCRIPTION OF VARIOUS EMBODIMENTS

Figure 1:
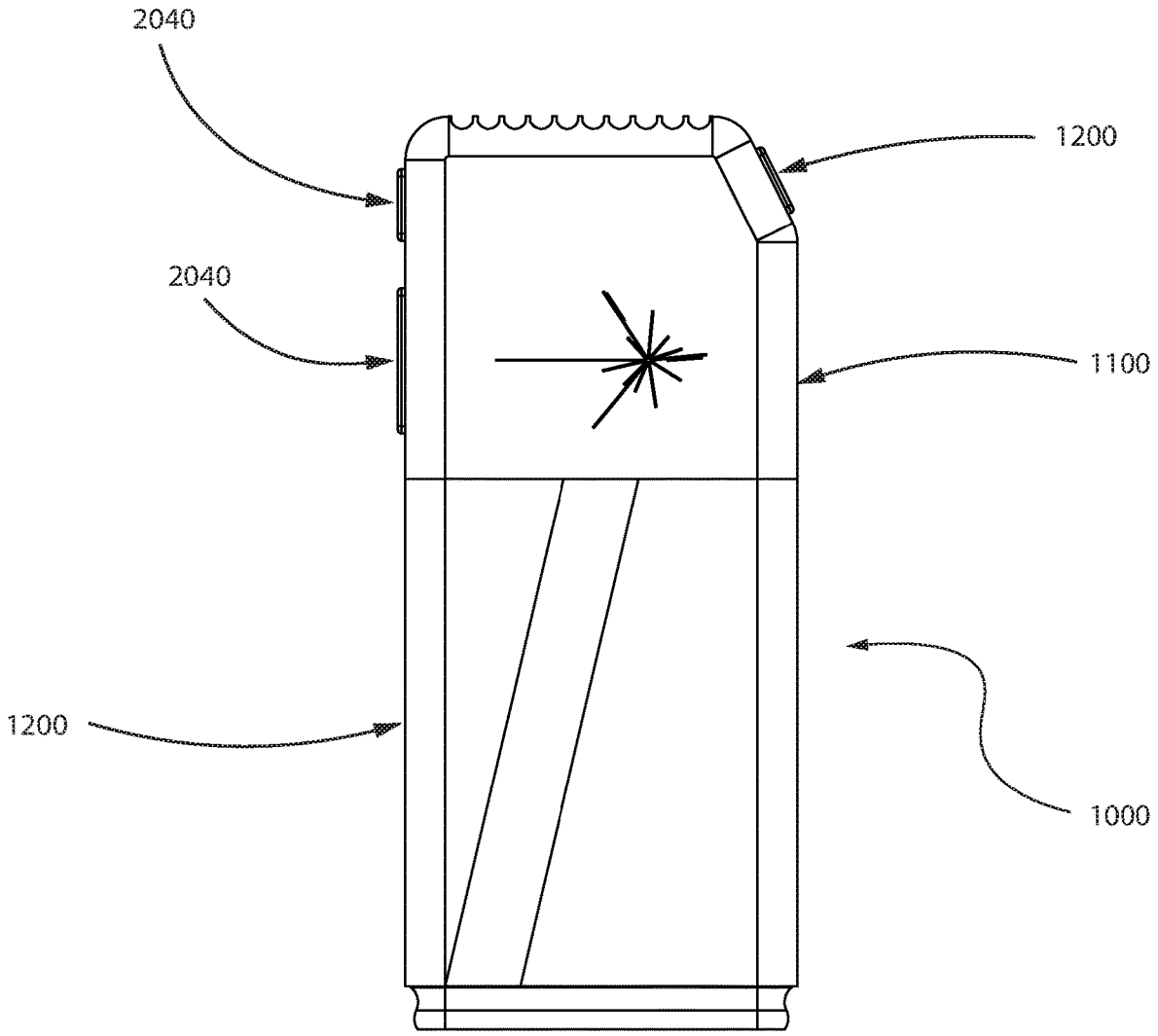
FIG. 1—A front view of certain embodiments of a device for dispensing fluids.
Figure 2A:
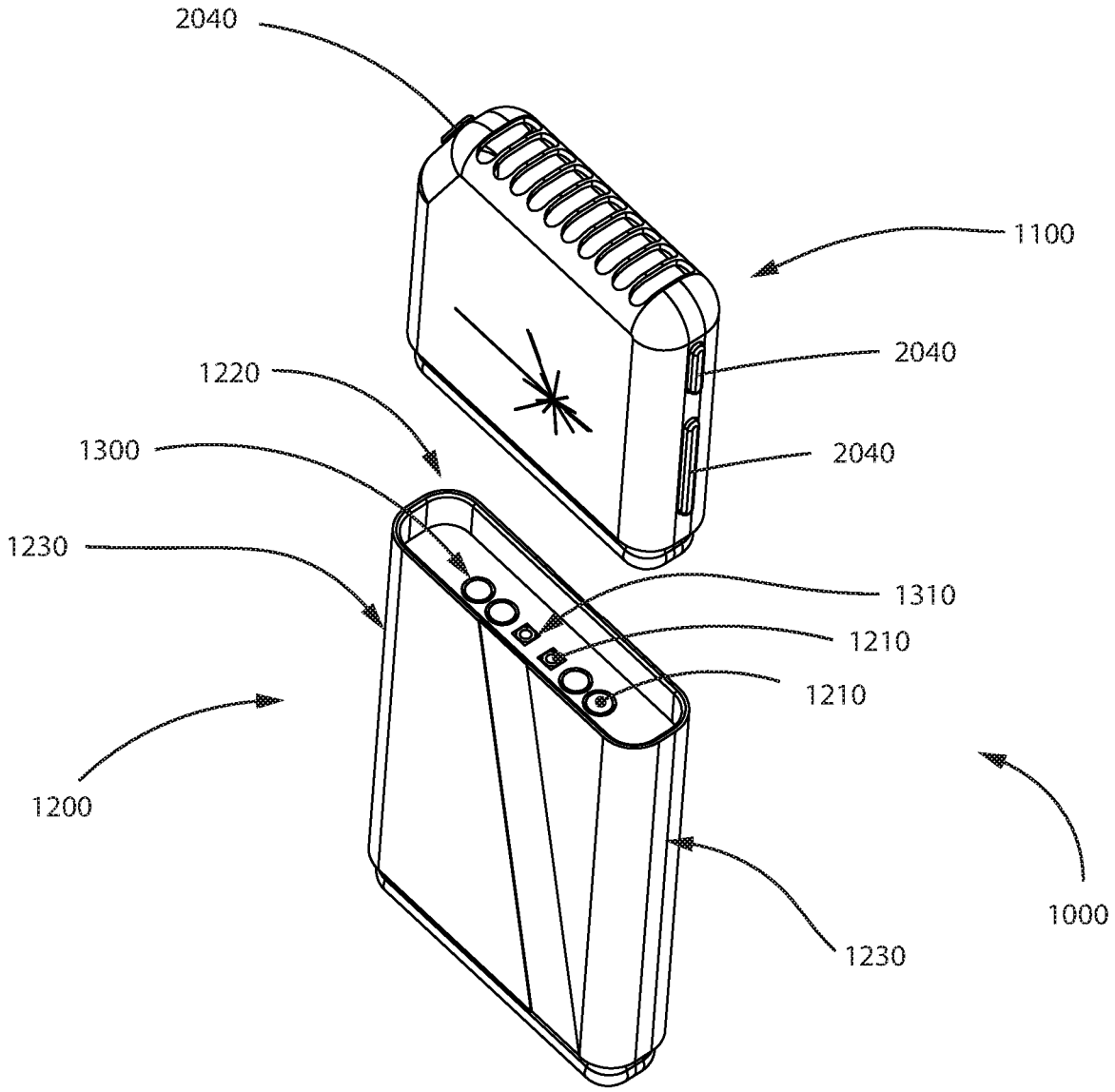
FIG. 2A—A perspective exploded view of a device for dispensing fluids comprising a dispenser and a removably interconnected pod.
Figure 2B:
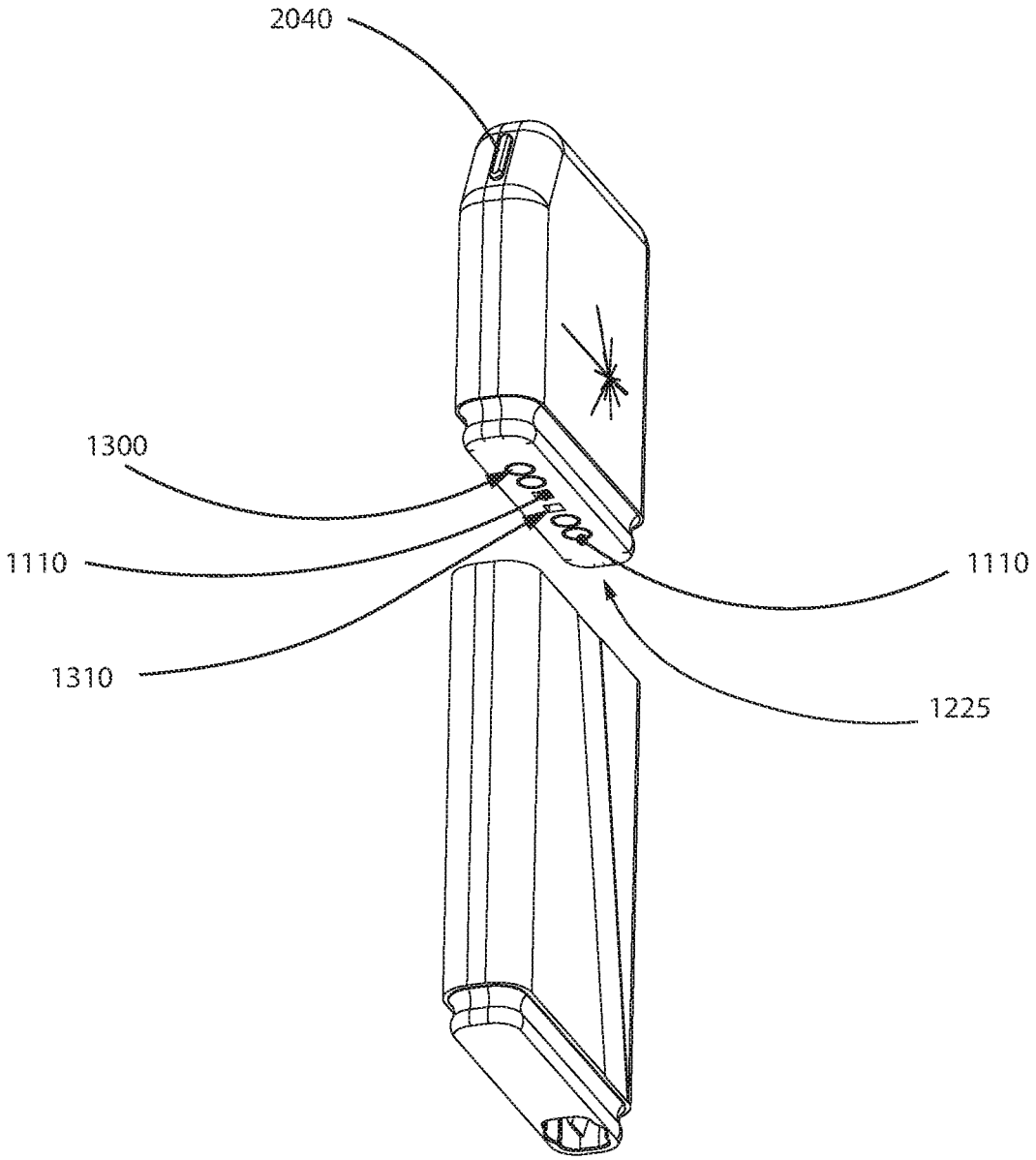
Figure 3:
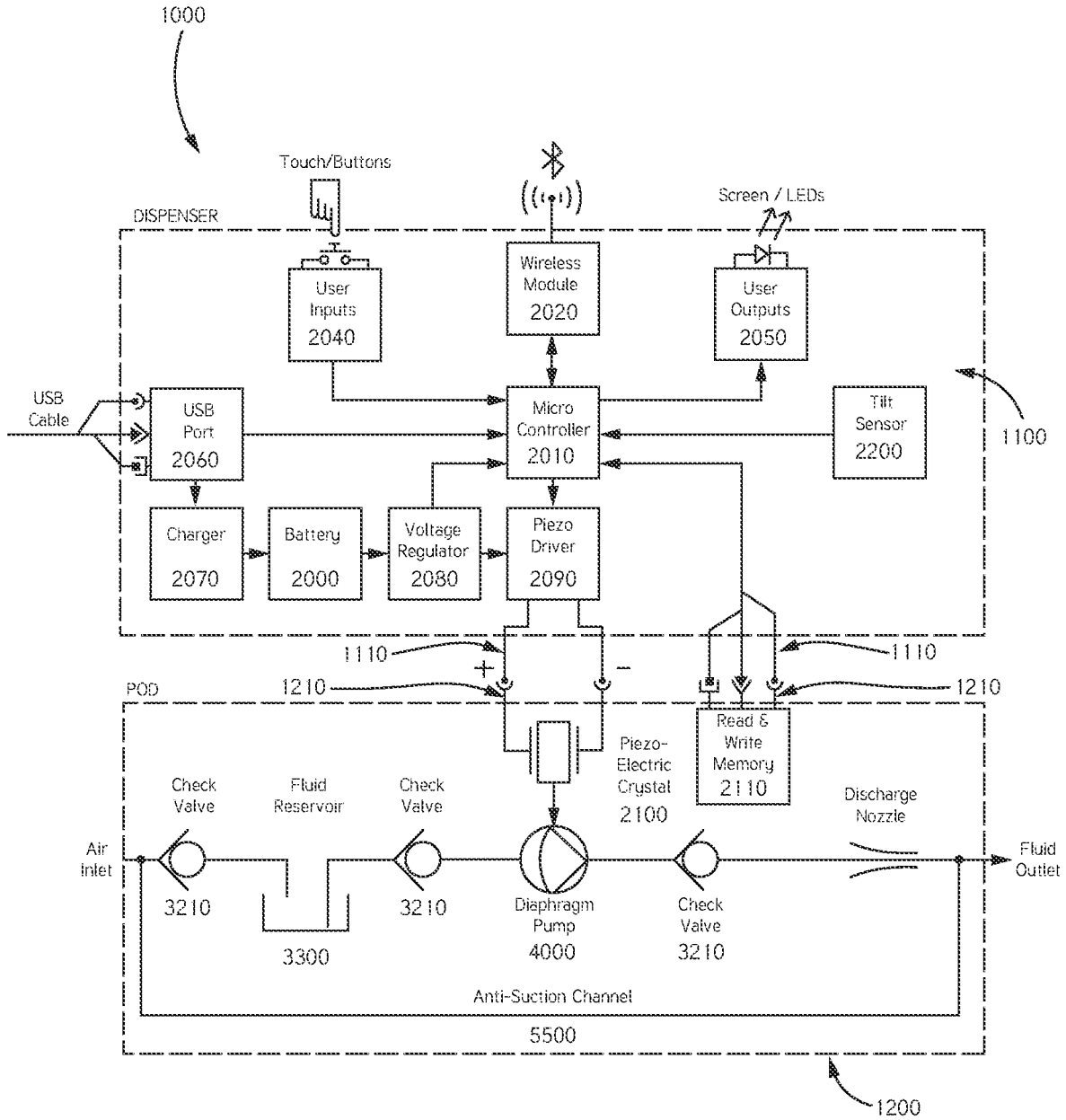
FIG. 3—A diagrammatic system representation of certain embodiments of a device for dispensing a fluid.

Certain embodiments of the present invention, shown in FIG. 1-FIG. 3, comprises a device 1000 for the dispensing of fluids, the device comprises a dispenser 1100 and a pod 1200. The dispenser 1100 comprises a power source 2000, central processing unit or controller (CPU) 2010. As shown, a bottom surface 1105 of the dispenser is configured to interconnect with a top aspect 1220 of the pod. It will be appreciated that the interconnection of the dispenser 1100 with the pod 1200 using alternative sides is within the spirit and scope of the present invention. When the dispenser 1100 is interconnected with the pod 1200, the dispenser 1200 is able to actuate the dispensing of a fluid from the pod 1200 by sending electrical signals from electrical connections 1110 of the dispenser, through electrical connections 1210 of the pod to the pod 1200. It will be appreciated that it is within the spirit and scope of the present invention send electromagnetic signals through electrical connections 1110. The dispenser 1100 of certain embodiments interconnects to the pod through use of electrical connections 1110, such as 1310 which comprise magnets 1300. The magnets 1300 of certain embodiments are located on the pod 1200, alternate embodiments comprise magnets 1300 on the dispenser 1100, and further alternate embodiments comprise magnets 1300 on pod 1200 and dispenser 1100. The magnets 1300 of such embodiments provide a mechanical connection between the pod 1200 and dispenser 1100. It will be appreciated that alternative mechanical connections known to those skilled in the art are within the spirit and scope of the present invention.

In certain embodiments, seen in FIG. 2A-FIG. 3, comprise a pod 1200 having a plurality of magnets 1300 configured to interconnect with a plurality of magnets 1300 of a dispenser. In such certain embodiments, the pod 1200 and the dispenser 1100 are configured to be interconnected with the pod 1200 in a first orientation, or a second orientation wherein the pod 1200 is rotated 180-degrees from the first orientation wherein the magnets 1300 of the dispenser, and the magnets 1300 of the pod are configured to interconnect in either the first orientation or the second orientation.

Certain embodiments, seen in FIG. 2A-FIG. 3, comprise a pod 1200 having a plurality of magnets 1300 configured to interconnect with a plurality of magnets 1300 of a dispenser. It may be desired to prevent the interconnection of a dispenser 1100 in a manner other than intended. Accordingly, the magnets 1300 of certain embodiments are configured in an asymmetric manner to prevent the mating of the dispenser to the pod in a manner other than intended. Further still, certain embodiments comprise a configuration of magnets 1300 on a pod wherein the poles (North and South) of the magnets prevent interconnecting the pod 1200 to the dispenser 1100 incorrectly. For instance, certain embodiments comprise four magnets embedded into a surface of the pod 1200, typically a top aspect 1220, wherein a first pair of magnets 1300 adjacent to a first side 1230 of the pod are directed with a first polarity toward the top aspect 1220, and a second pair of magnets adjacent to a second side 1230 of the pod are directed with a second polarity toward the top aspect 1220. Accordingly, a dispenser 1100 having magnets 1300 configured to interconnect with the magnets 1300 of the pod having opposite polarities, are able to interconnect when the pod 1200 is aligned in the intended orientation. However, if a user attempts to interconnect the pod 1200 with the dispenser 1100 with the pod rotated 180-degrees from the intended orientation for instance, the magnets 1300 of the pod will align with magnets of the dispenser having matching polarities resulting in the dispenser 1100 and pod 1100 repelling each other and preventing the interconnection of the pod 1200 and dispenser 1100.

In certain embodiments, shown in FIG. 2A-FIG. 2B, a top aspect 1220 of a pod comprises a first and second electrical contacts 1210 comprising spring-loaded electrical connectors 1310. The electrical contacts allow the electrical connection between the dispenser 1100 and the pod 1200, and allows the dispenser 1100 to send electrical signals to the pod to dispense an amount of fluid. Certain embodiments comprise spring-loaded electrical connectors 1310 often referred to as "pogo-pins" by those skilled in the art. Certain embodiments comprise the electrical connections 1110 of the dispenser comprising spring-loaded electrical connectors 1310.

Figure 4A:
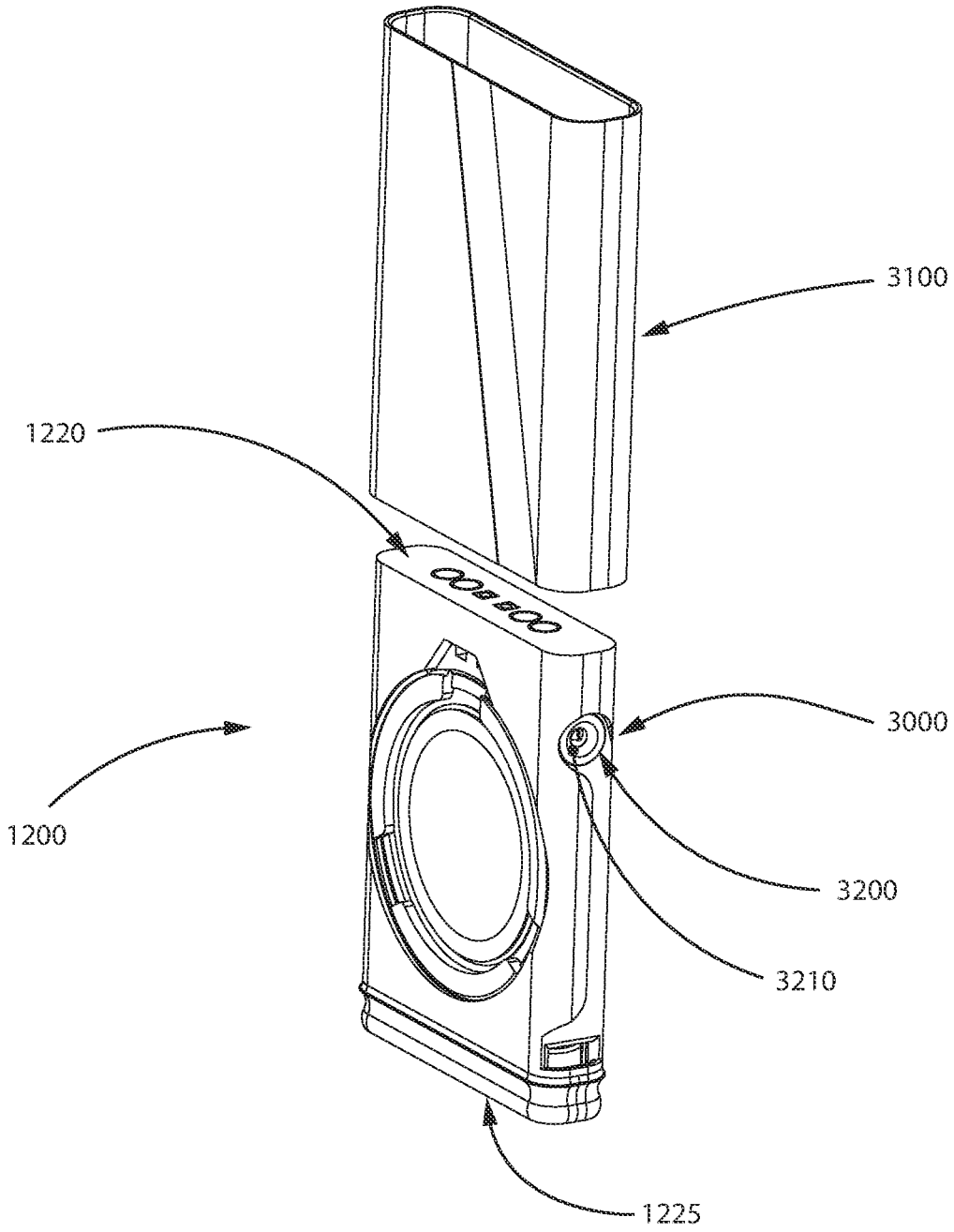
FIG. 4A—A perspective exploded view of a device for dispensing fluids comprising a pod.

Certain embodiments comprising a pod 1200, shown in FIG. 4A comprise a body 3000 surrounded by a sleeve 3100. In certain embodiments the sleeve 3100 is slidably disposed over the body 3000 of the pod. In certain embodiments a sleeve is disposed around the body of the pod, thereby obscuring view and access to portions of the body of the pod except a top aspect 1220 and bottom aspect 1225 of the pod.

Figure 4B:
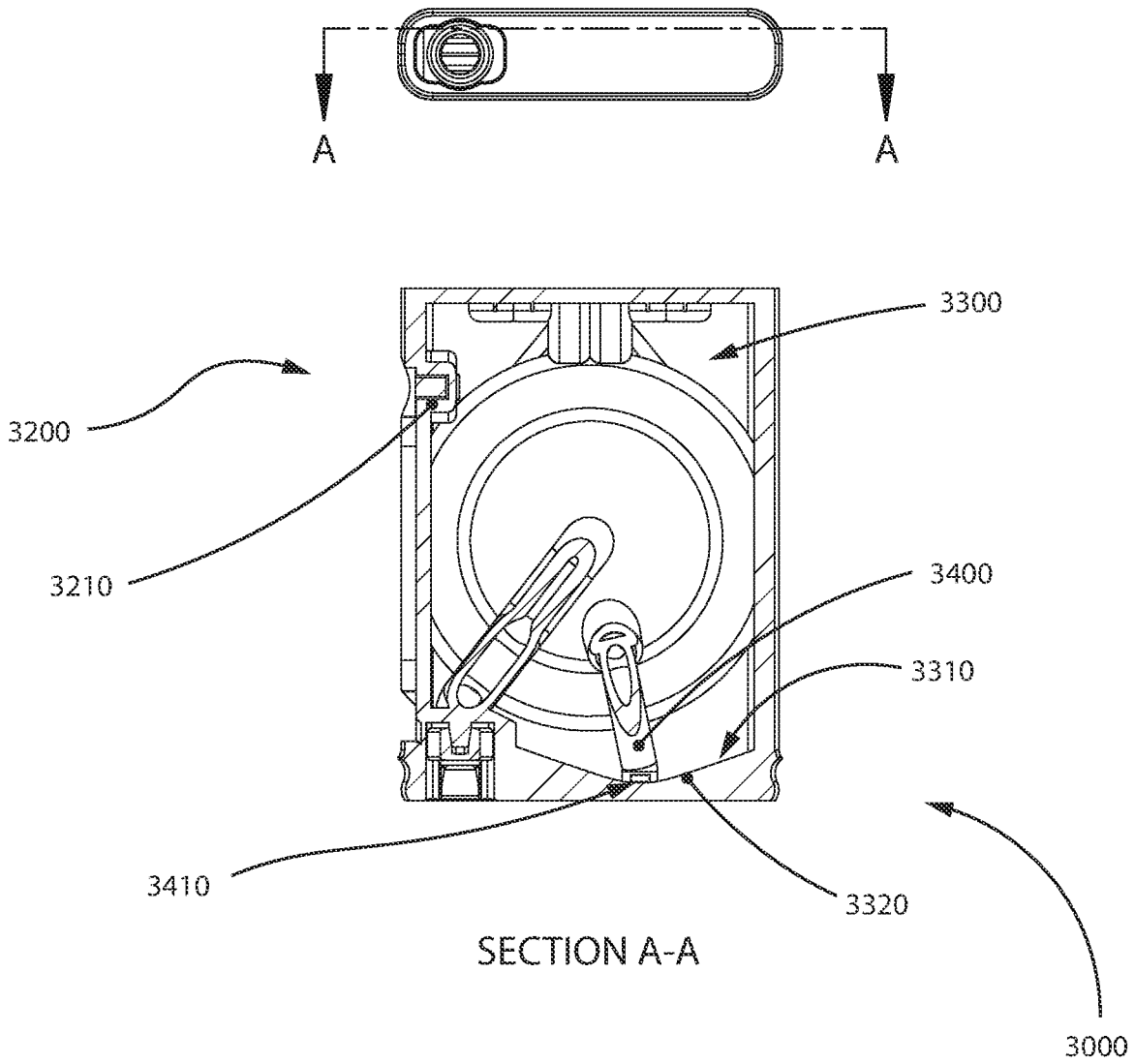

A pod 1200 of certain embodiments, as shown in FIG. 4A-FIG. 4B comprises a body 3000 having a fill-port 3200 comprising a one-way valve 3210 disposed in an external surface of the body 3000. The one-way valve 3210 provides fluid communication between an external aspect of the body and a reservoir 3300 disposed within the body 3000. The fill-port 3200 is typically configured to be adjacent to a top aspect 1220 of the body when the body is held in an orientation for dispensing. However, it will be appreciated that a fill port 3200 can be located adjacent to other aspects of the body 3000—such as a bottom aspect, or side aspect—while in keeping with the spirit and scope of the present invention.

In certain embodiments, shown in FIG. 4B, the reservoir 3300 comprises a cavity within the body 3000 wherein the fluid can be contained and drawn from for the dispensing of the fluid. The reservoir comprises a volume having a bottom aspect 3310 further comprising a sump 3320. It will be appreciated that the term sump refers to a low point, pit, hollow, or concavity configured to accumulate fluid. A sump 3320 is typically disposed at the lowest point of the reservoir 3300 when the body 3000 is held in an orientation for dispensing and thus preventing air from entering into the siphon tube 3400 and into the pump 4000 (FIG. 5A).

In certain embodiments, again referencing FIG. 4B, a siphon tube 3400 is disposed within the sump 3320 of the reservoir to draw fluid from the reservoir 3300 when fluid is dispensed. While embodiments illustrated herein show a siphon tube 3400 which is configured to draw fluid upward from the sump 3320 of the reservoir, it will be appreciated that alternate embodiments comprising a siphon tube 3400 configured to draw fluid downward or laterally from the reservoir 3300 is within the spirit and scope of the present invention. In certain embodiments, the siphon tube 3400 is configured to draw fluid upward from the sump 3320 of the reservoir, wherein the siphon tube 3400 is interconnected with the sump 3320 of the reservoir, and further comprises apertures 3410 through the siphon tube 3400, wherethrough the fluid is drawn from the reservoir 3300 and into the siphon tube 3400. The apertures 3410 are located at the bottom of the sump 3320, further preventing air from entering the siphon tube 3400 or the pump 4000.

A pump 4000 of certain embodiments, shown in FIG. 4B-FIG. 5B is disposed within the body 3000, wherein the pump 4000 has fluid communication the reservoir 3300 through a siphon tube 3400. In certain embodiments a one-way valve 3210 is disposed between the siphon tube 3400 and the reservoir 3300 wherein the fluid passes through the one-way valve 3210 before entering the pump 4000. It will be appreciated that alternate embodiments wherein the one-way valve 3210 is disposed between the siphon tube 3400 and the reservoir 3300 are within the spirit and scope of the present invention.

Figure 5A:
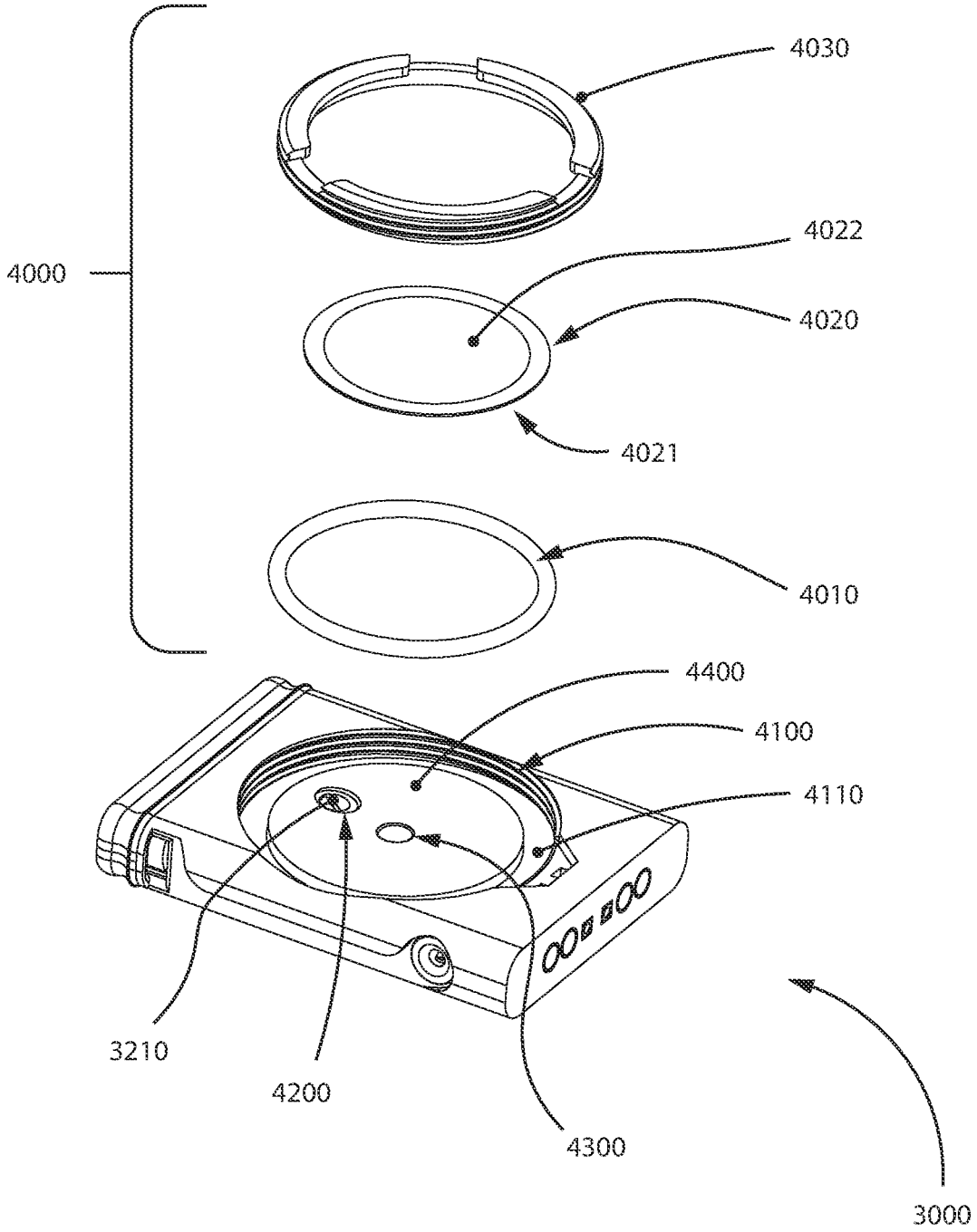
FIG. 5A—A perspective exploded view of a device for dispensing fluids comprising a pod.
Figure 5B:
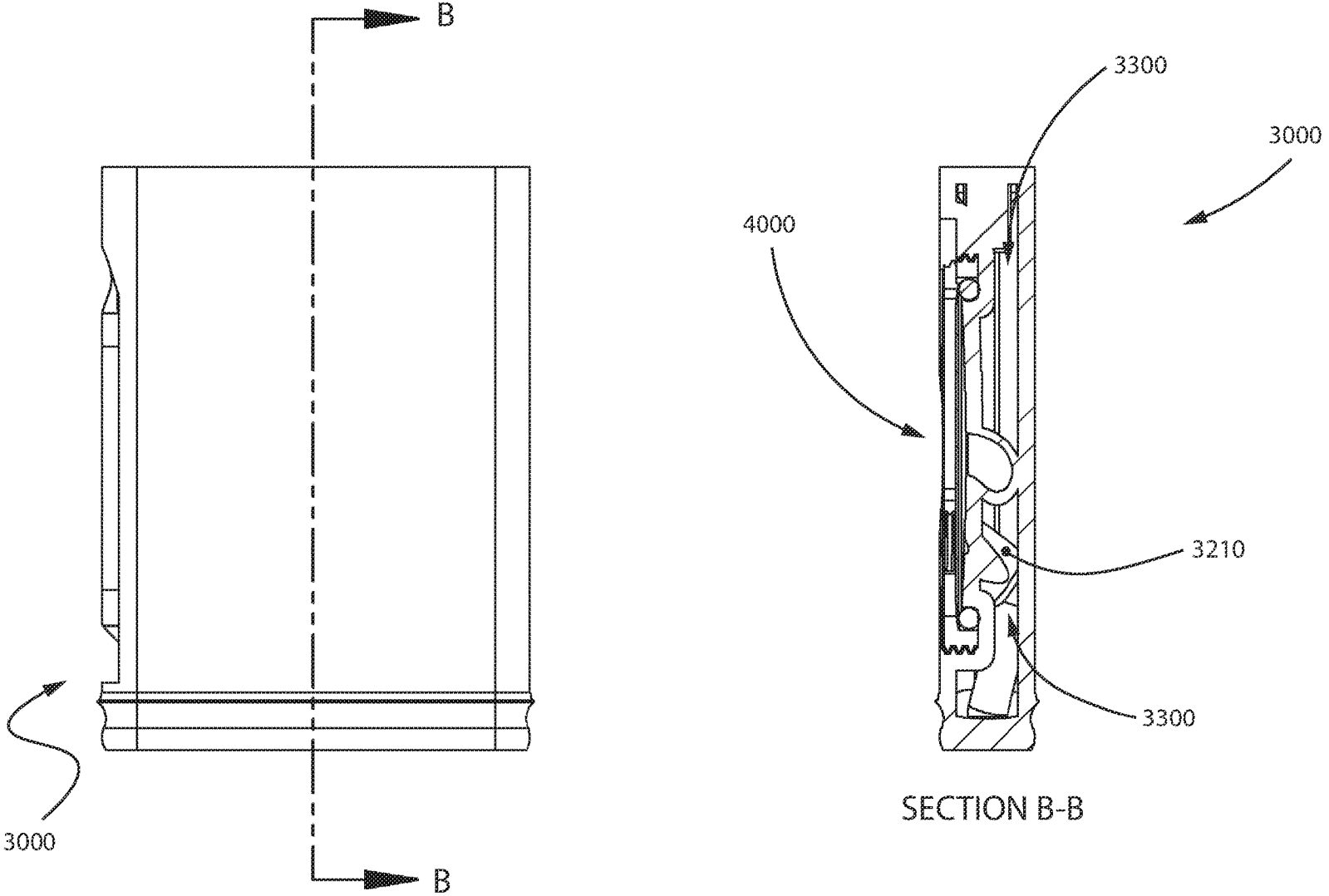

In certain embodiments, seen in FIG. 5A, a pump 4000 comprises a diaphragm pump comprising an O-ring 4010, a diaphragm 4020, and a compression element 4030. The O-ring 4010 of certain embodiments is disposed against a bottom aspect 4110 of a threaded recess 4100 of the body. In certain embodiments, a first face 4021 of the diaphragm is disposed against the O-ring 4010, and the threaded compression element 4030 is disposed against a second face 4022 of the diaphragm. The threaded compression element 4030 is configured to threadably interconnect with the threaded recess 4100 of the body in order to impart pressure on the second face 4022 of the diaphragm. When the threaded compression element 4030 is threadably interconnected with the threaded recess 4100 and threadably advanced, the threaded compression element 4030 imparts pressure on the second face 4022 of the diaphragm, thereby resulting in the first face 4021 of the diaphragm imparting pressure on the O-ring 4010. When pressure is imparted on the O-ring 4010, the O-ring compresses and deforms thereby creating a seal between the O-ring 4010 and the bottom aspect 4110 of the threaded recess and a seal between the O-ring 4010 and the first face 4021 of the diaphragm.

In certain embodiments, a pump 4000 is assembled within the body 3000 wherein the pump 4000 and associated elements are integrated with the body 3000 through the use of soldering, welding, over-molding, adhesive, or other methods appreciated by those skilled in the art.

It will be appreciated that a diaphragm pump, sometimes referred to as a membrane pump, is a positive displacement pump that uses a combination of a reciprocating action of a flexible membrane to pump a fluid. It will be appreciated that the diaphragm of a diaphragm pump 4000 of various embodiments comprise rubber, thermoplastics, Teflon® and/or metal while remaining within the spirit and scope of the present invention.

Certain embodiments, shown in FIG. 5A-FIG. 6B comprise a diaphragm pump 4000 which actuates an intake stroke 4500 and ejection stroke 4600 using piezoelectric effects. When power is supplied to the pump 4000, the diaphragm 4020 deforms away from the body 3000 in an intake stroke 4500, drawing fluid into the pump 4000 through the inlet port 4200. When power is cut from the pump 4000, the diaphragm 4020 rebounds to its resting configuration toward the body 3000 in an ejection stroke 4600, forcing fluid out of the pump through the outlet port 4300. In an intake stroke 4500, the diaphragm pump 4000 creates a suction action wherein fluid is drawn from the reservoir 3300, through the siphon tube 3400, through a one-way valve 3210, and through an inlet port 4200 into the pump 4000. In an ejection stroke 4600, the diaphragm pump 4000, the diaphragm creates a positive pressure, forcing the fluid out of the pump 4000 through an outlet port 4300.

Figure 6A:
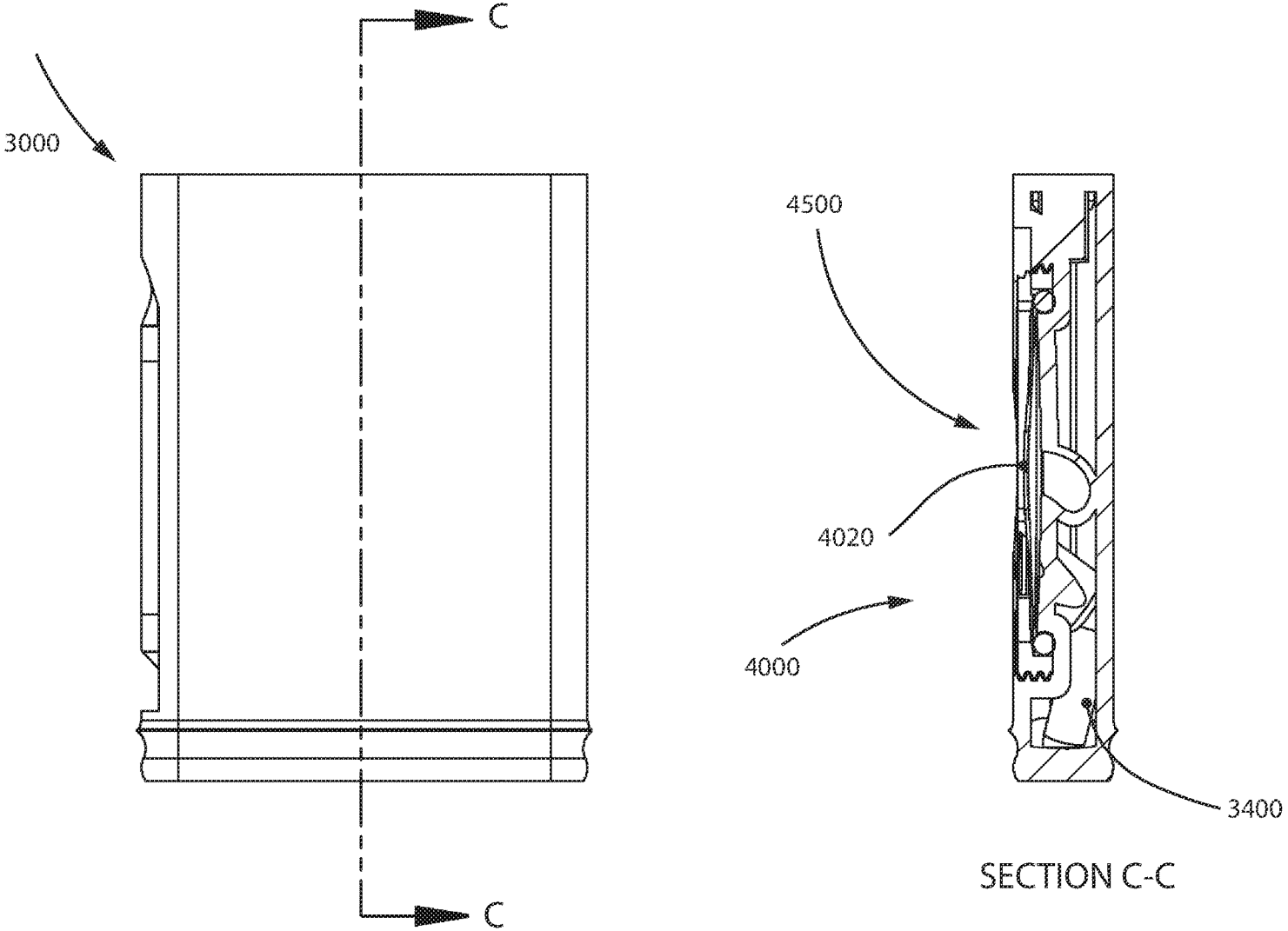
FIG. 6A—A side cross-sectional view of a device for dispensing fluids comprising a pod in an intake stroke configuration.
Figure 6B:
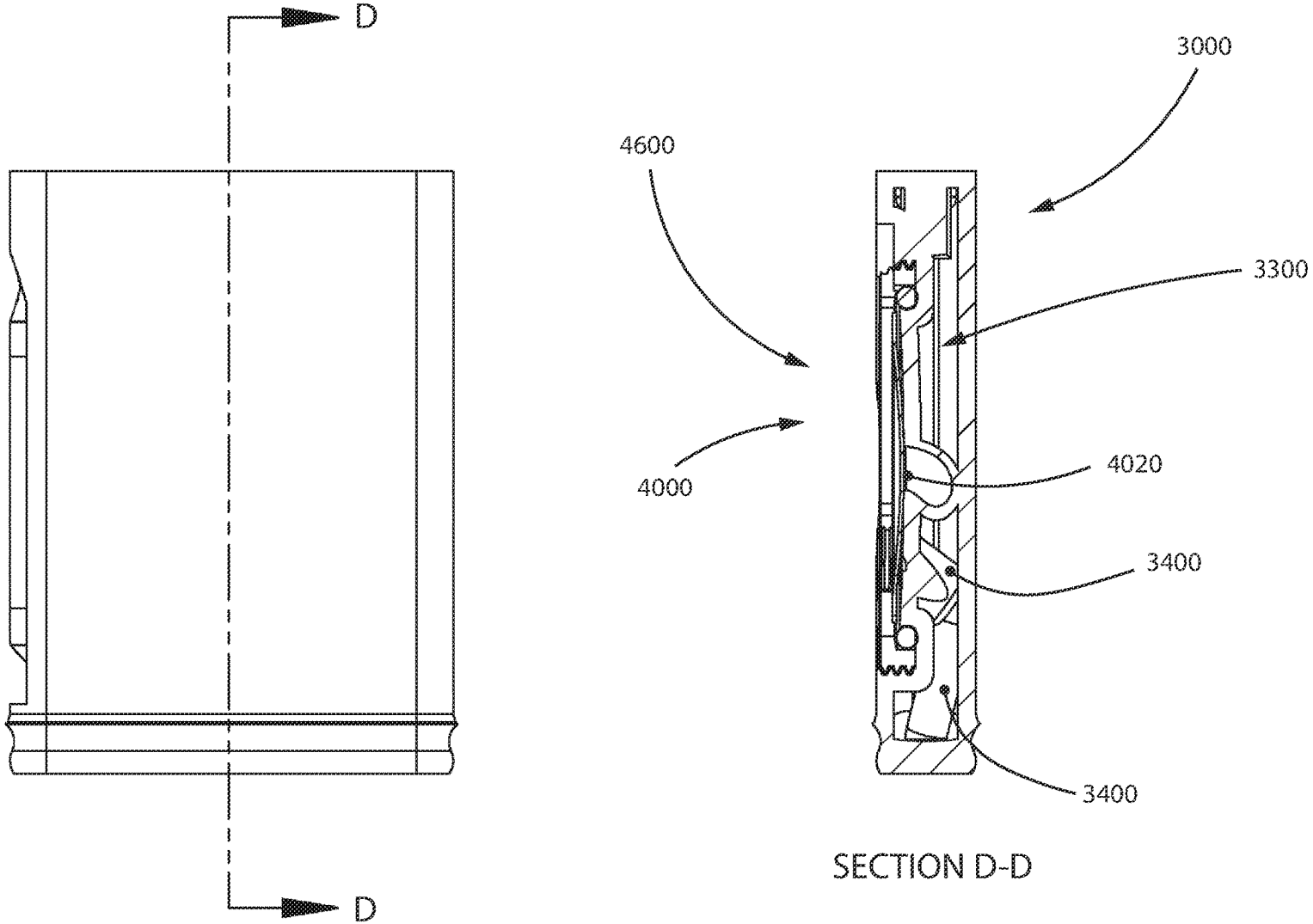
Figure 7:
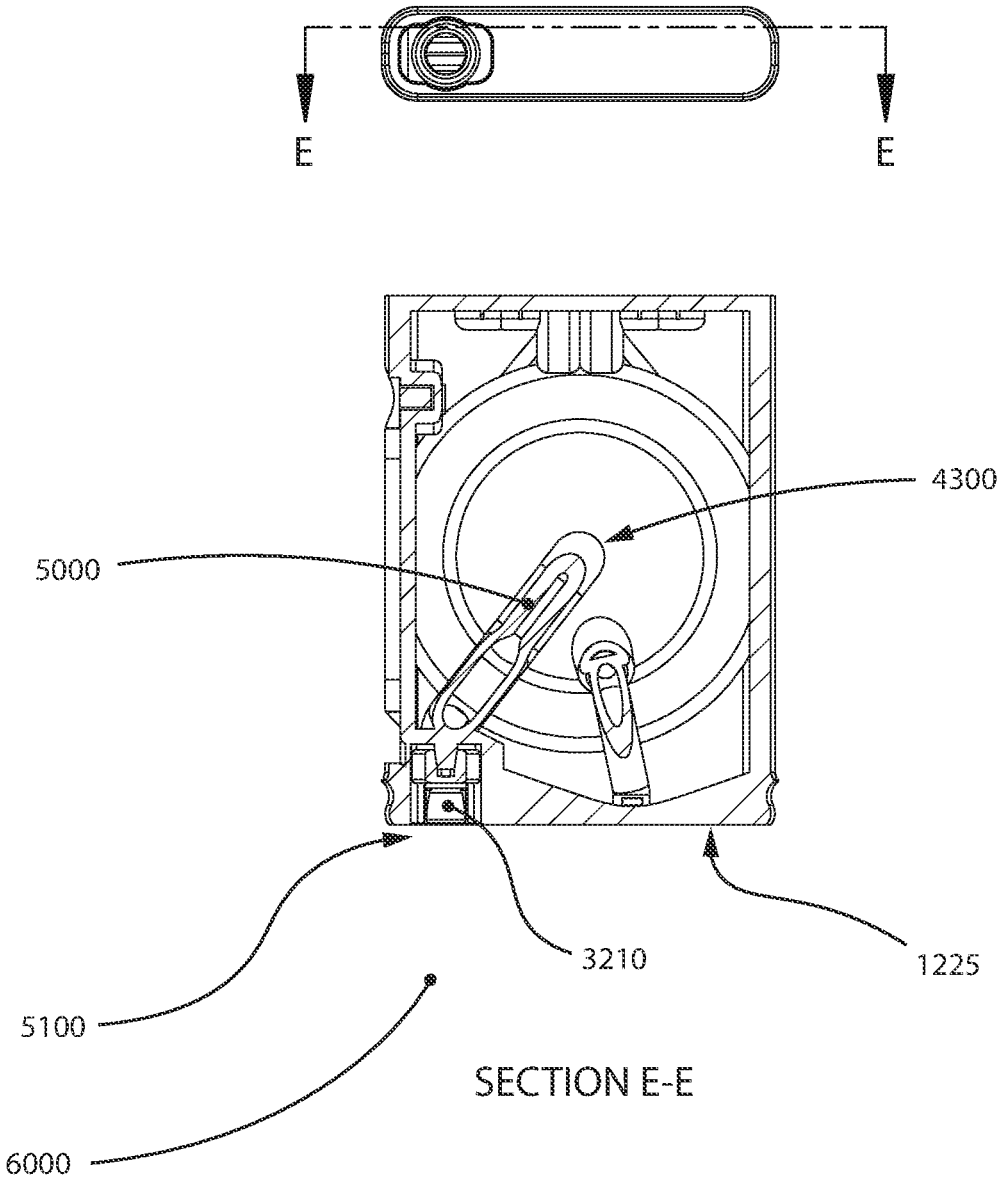
FIG. 7—A front cross-sectional view of a device for dispensing fluids comprising a pod.
Figure 8:
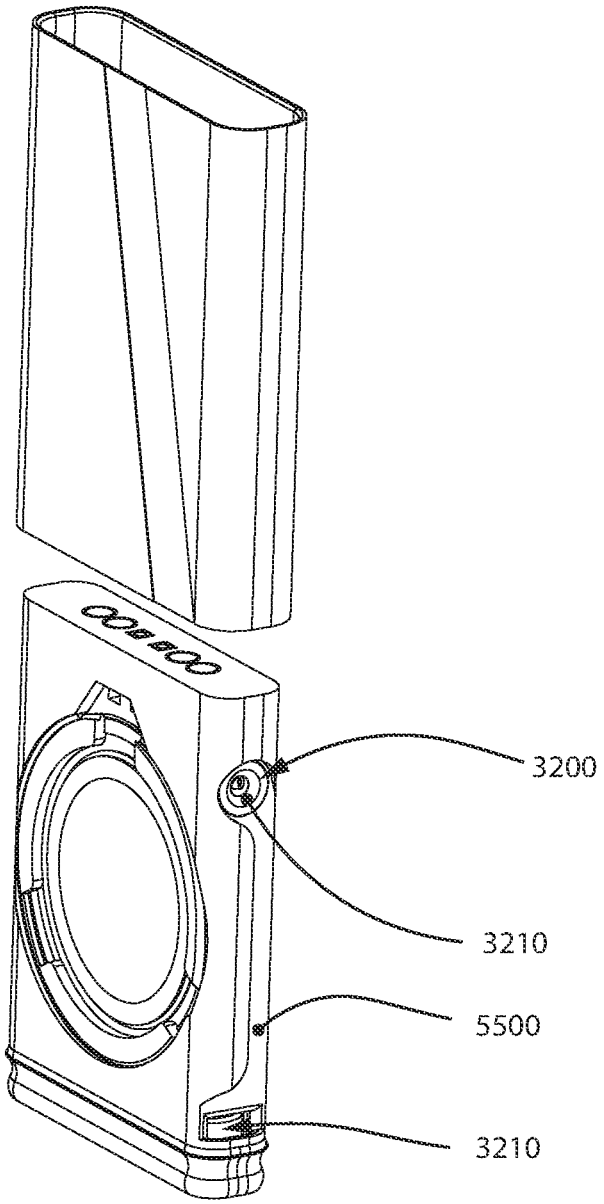
FIG. 8—A perspective exploded view of a device for dispensing fluids comprising a pod.

In certain embodiments (FIG. 5A) a diaphragm pump 4000 comprises a concave 4400 surface wherein the inlet port 4200 and outlet port 4300 are disposed. The concave surface 4400 is configured to interface with the diaphragm 4020 of the diaphragm pump and control the pump "one-stroke" capacity. In certain embodiments, the inlet port 4200 is located in the concave surface 4400, offset from a central aspect of the concave surface 4400. In certain embodiments, the outlet port 4300 is located in the concave surface 4400, adjacent or coincident with the central aspect of the concave surface 4400. The proximity of the outlet port 4300 to the center of the concave surface 4400 allows for most power is in the center more complete ejection of all fluid in the diaphragm pump 4000 during an ejection stroke 4600 (FIG. 6B). In certain embodiments the concavity of the concave surface 4400 is configured to match the curvature of the diaphragm 4020 in an ejection stroke 4600.

In certain embodiments, an outlet duct 5000 is connected to the outlet port 4300. The outlet duct 5000 provides fluid communication between the outlet port 4300 and an external aspect of the pod 1200. In certain embodiments, an outlet 5100 comprising a one-way valve 3210 is disposed between the outlet duct 5000 and an external aspect 6000 of the pod. The one-way valve 3210 allows fluid flow only in the direction from the outlet duct 5000 to the external aspect 6000 of the pod. In certain embodiments the one-way valve 3210 between the outlet duct 5000 and the external aspect 6000 of the pod is disposed on a bottom aspect 1225 of the body of the pod.

In certain embodiments an anti-suction channel 5500 is in gaseous communication with the outlet valve 3210 and the fill-port 3200 of the pod. The anti-suction channel 5500 provides an air-filled volume which serves multiple purposes. A first purpose of the anti-suction channel 5500 is to provide make-up air for the fill-port 3200. As fluid is dispensed, this creates a suction in the reservoir 3300 (FIG. 4B) which is relieved by the fill-port 3200 permitting the passage of air from the anti-suction channel 5500 into the reservoir 3300. A second purpose of the anti-suction channel 5500 is to prevent the misuse of the pod whereby an individual attempts to suck fluid from the outlet valve. The anti-suction channel provides an unsealed plenum of ambient air wherein the sucking of air from a bottom aspect of the pod results in drawing air from the anti-suction channel 5500 and gaps between the body 3000 and the sleeve 3100.

Figure 9:
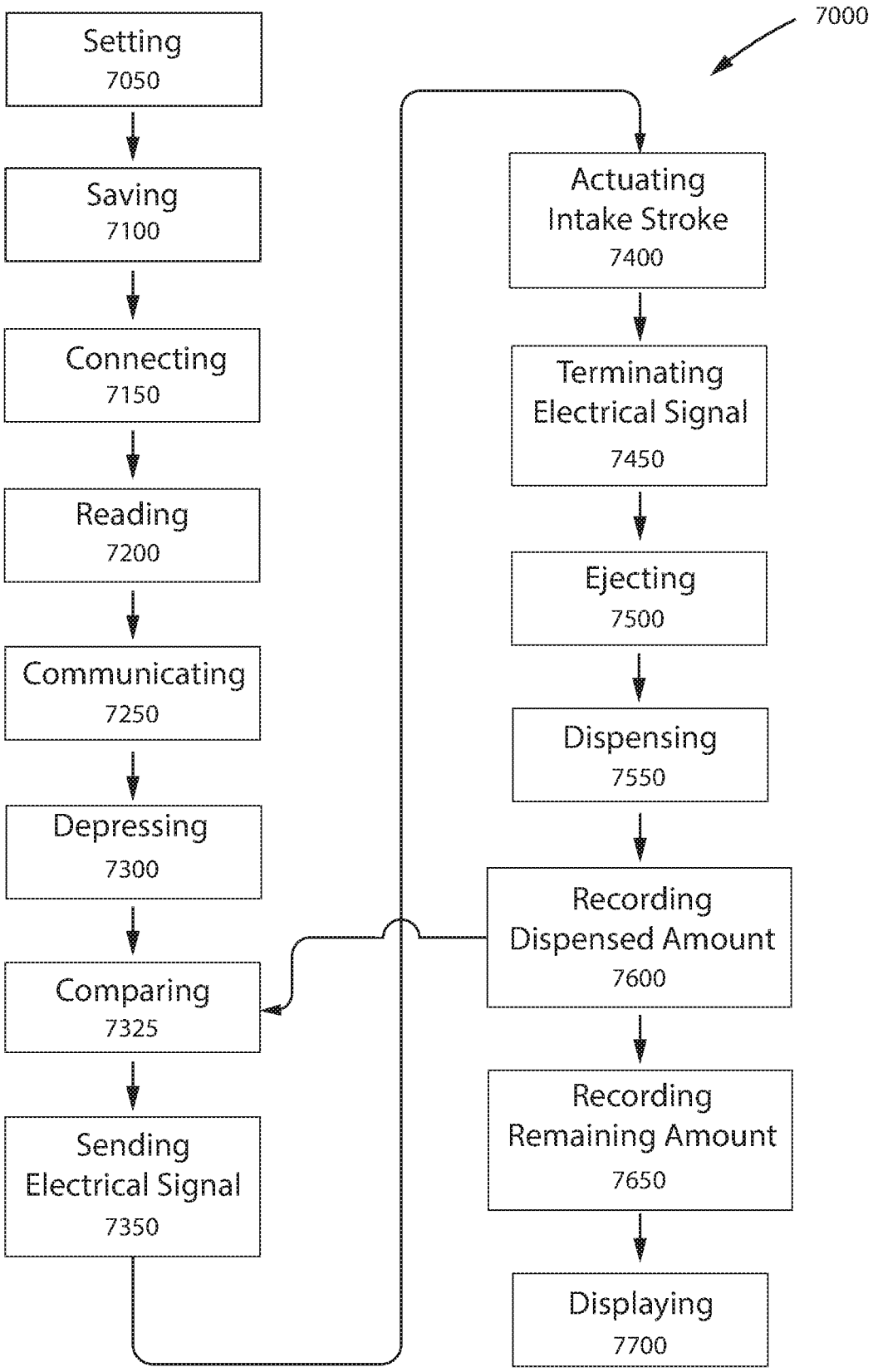
FIG. 9—A diagrammatic representation of a method for dispensing fluids.

Certain embodiments, as shown in FIG. 9, comprise a method 7000 for the dispensing of a fluid comprise:

a) Setting 7050 a preferred dose on a dispenser;
b) Saving 7100 the preferred dose amount to a controller of the dispenser;
c) Connecting 7150 a pod to the dispenser;
d) Reading 7200 pod information from the pod, and saving the pod information to the dispenser;
e) Communicating 7250 wirelessly the pod information from the dispenser to a connected computing device;
f) Depressing 7300 a button disposed on the dispenser;
g) Sending electrical signal 7350 to the pod to actuate an intake stroke;
h) Actuating the intake stroke 7400 of a diaphragm pump resulting in drawing the fluid from a reservoir, through a first one-way valve, through an inlet port, and into the diaphragm pump;
i) Cutting electrical signal 7450 of the electrical signal resulting in actuating an ejection stroke of the diaphragm pump;
j) Ejecting 7500 the fluid from the diaphragm pump through an outlet port and through a second one-way valve;
k) Dispensing 7550 the fluid from the pod;
l) Recording dispensed amount 7600 and time of dispensing to the dispenser;
m) Recording remaining amount 7650 of fluid to the pod; and
n) Displaying 7700 the remaining amount of fluid remaining.

In certain embodiments, a user sets 7050 a preferred dose amount which is saved 7100 to the controller of the dispenser. The dispenser is configured to be removably connected to a pod, and when a user connects 7150 a pod to the dispenser, the dispenser reads 7200 the information from the pod and stores it on the controller. In certain embodiments, the reading step 7200 comprises reading a max dosage permitted for dispensing in a predetermined time period. Certain embodiments further comprise a comparing 7325 step performed prior to the sending electrical signal 7350 step. The comparing step 7325 compares the recorded dispensed amount from previous recording steps 7650 in the predetermined time period prior to the depressing 7300 of the button. If the recorded amount dispensed within the predetermined time period prior to the depressing step 7300 is equal to or greater than the max dosage, the dispenser will not send an electrical signal 7350, thus preventing the dispensing in excess of the max dosage within the predetermined time period. After a max dosage in the predetermined time period is reached, the dispenser will not further dispense fluid until enough time has passed such that less than the max dosage has been dispensed in the predetermined time period prior to the depressing 7300 of the button on the dispenser. I The dispenser of certain embodiments, shown in FIG. 3, further comprises a wireless module 2020 which allows wireless communication with other computing devices 2030 such as a smart phone, computer, or other computing device having local network or internet connectivity. The dispenser of certain embodiments further comprises user input devices, such as buttons 2040, a display 2050, a USB port 2060 for wired connection to other computing devices, a charging circuit 2070, a battery for power storage 2000, a voltage regulator 2080, a driver 2090 for the delivery of electrical signals from the dispenser to a pod, electrical connections for the purposes of providing power and electrical signals between the dispenser and pod, and electrical connections for the purpose allowing the reading and writing of data between the dispenser and the pod.

In certain embodiments, the pod comprises memory storage 2110 wherein the dispenser can store the data associated with the dispensed amount, date of dispensing, and/or the amount of fluid remaining in the pod. Certain embodiments of the pod comprises a piezo-electric crystal 2100.

In certain embodiments as shown in FIG. 9—user input, such as the depressing of a button 2040 (FIG. 1-FIG. 3) indicates to the dispenser that the user wishes to dispense the pre-programmed desired amount of fluid. The depressing 7300 of the button initiates the controller sending 7350 electrical signals through the driver and through the driver to the pod. The electrical signal actuates 7400 the pump into an intake stroke wherein the diaphragm deflects from the body and away from the concave surface of the body. During the intake stroke the fluid is drawn from the reservoir, through the siphon tube, and through a first one-way valve into the pump. Following the intake stroke, terminating the electrical signal 7450 results in the diaphragm deflecting toward the concave surface in an ejection stroke, thereby ejecting 7500 the fluid from the pump through an outlet port of the pump, though an outlet duct, and through a one-way valve and thereby dispensing 7550 the fluid. Following the dispensing of fluid, in certain embodiments, the dispenser records 7600 the dispensed amount and time of dispensing to the dispenser. In certain embodiments, the method further comprises a step wherein the dispenser records 7650 the amount remaining within the pod to the memory of the pod.

In certain embodiments comprising a dispenser, the dispenser further comprises a tilt sensor 2200 (FIG. 3), wherein the dispense does not send an electrical signal unless the device is in an upright orientation (FIG. 1) or substantially upright to ensure dispensing in the right direction and prevent air from entering the pump. It will be appreciated that a tilt sensor 2200 of certain embodiments comprises an accelerometer to measure the direction of gravitational acceleration, thus confirming the upright orientation of the pod prior to dispensing.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A device for the dispensing of a fluid comprising:

a pod comprising a body, the body comprising a reservoir therein, the reservoir configured to contain a fluid;

the body further comprising a pump, the pump comprising an inlet port interconnected with the reservoir;

the pump further comprises an outlet port interconnected with an outlet duct, the outlet duct having fluid communication with an external aspect of the body;

a dispenser having a first side configured to removably interconnect with the pod;

the dispenser further comprising a power source to actuate the pump; and a tilt sensor configured to determine orientation of the device, wherein the pump dispenses the fluid from the reservoir, through the outlet duct to the external aspect of the body, wherein if the tilt sensor detects the device in an upright position, the dispenser allows the actuation of the pump, and wherein if the tilt sensor detects the device is not in an upright position, the dispenser does not allow the actuation of the pump.

2. The device of claim 1, further comprising a first one-way valve interconnected with a first side of the body, wherein the first one-way valve is in fluid communication between the external aspect of the body and the reservoir, allowing fluid flow from the external aspect of the body toward the reservoir.

3. The device of claim 2, further comprising a second one-way valve interconnected between the outlet duct of the pump and the external aspect of the body.

4. The device of claim 3, wherein the second one-way valve is interconnected with a second side of the body.

5. The device of claim 4, wherein the second side of the body comprises a bottom aspect of the body.

6. The device of claim 5, wherein the pump comprises a diaphragm pump.

7. The device of claim 6, wherein the inlet port of the pump is offset from a central aspect of the pump; and the outlet port coinciding with the central aspect of the pump.

8. The device of claim 6, wherein the diaphragm pump further comprises a concave surface wherethrough the inlet port enters the diaphragm pump, and wherethrough the outlet port exits the diaphragm pump.

9. The device of claim 8, wherein the diaphragm pump further comprises a diaphragm having electrical connections for interconnection to the power supply of the device.

10. The device of claim 9, wherein applying electrical power to the diaphragm results in deflection of the diaphragm away from the concave surface, thereby drawing fluid from the reservoir into the diaphragm pump through the inlet port of the diaphragm pump, and wherein terminating the electrical power to the diaphragm results in the bending of the diaphragm toward the concave surface, thereby pushing fluid from the diaphragm pump through the outlet port of the diaphragm pump.

11. The device of claim 5, further comprising a siphon tube interconnected between the inlet port of the pump and the reservoir.

12. The device of claim 11, wherein the siphon tube is interconnected with a sump of the reservoir.

13. The device of claim 12, wherein the siphon tube further comprises apertures adjacent to the sump, wherein the fluid is drawn through the apertures into the siphon tube, and into the pump.

14. The device of claim 11, further comprising a third one-way valve having fluid communication between the siphon tube and the inlet port of the pump, wherein the third one-way valve allows fluid flow from the reservoir toward the inlet port of the pump.

15. The device of claim 3, further comprising:

a channel extending between the first one-way valve and the second one-way valve, wherein the channel allows gaseous communication between the first one-way valve and the second one-way valve.

16. The device of claim 1, wherein the first side of the dispenser comprises electrical connections configured to interconnect with electrical connections of the pod, the electrical connections of the pod interconnected with an external aspect of the pod.

17. The device of claim 16, wherein the first side of the dispenser further comprises magnets configured to interconnect with magnets in the external aspect of the pod.

18. The device of claim 17, wherein the external aspect of the pod comprises a top aspect of the pod.

19. A device for the dispensing of a fluid comprising:

a body;

a first side of the body comprising a plurality of magnets and electrical connectors, wherein a dispenser comprising a power source configured to interconnect with the plurality of magnets and electrical connectors;

a tilt sensor configured to determine orientation of the device, wherein if the tilt sensor detects the device in an upright position, the dispenser allows the actuation of the pump, and wherein if the tilt sensor detects the device is not in an upright position, the dispenser does not allow the actuation of the pump;

a reservoir disposed within the body;

a first one-way valve disposed in a second side of the body, the first one-way valve having fluid communication with an external aspect of the body and the reservoir, the first one-way valve allowing fluid flow from an external aspect of the body toward the reservoir;

a siphon-tube configured to draw fluid from a sump in the reservoir, the siphon-tube connected to a second one-way valve;

the second one-way valve having fluid communication with the siphon-tube and a diaphragm pump, the second one-way valve allowing fluid flow from the reservoir toward an inlet port of the diaphragm pump;

the diaphragm pump further comprising an electrical connection to a power source;

the diaphragm pump further comprising a concave surface;

the inlet port located in the concave surface and radially offset from a central aspect of the concave surface;

an outlet port located in the concave surface adjacent to a central aspect of the concave surface;

an outlet duct having fluid communication with the outlet port and a third one-way valve;

the third one-way valve disposed in a third side of the body, the third one-way valve having fluid communication with the outlet duct and the external aspect of the body, the third one-way valve allowing fluid flow from the outlet duct toward the external aspect of the body;

the external aspect of the body further comprising a channel in gaseous communication between the first one-way valve and the third one-way valve;

wherein the application of power to the diaphragm pump results in the bending of the diaphragm pump away from the concave surface, thereby drawing fluid from the reservoir through the second one-way valve, through siphon tube, and into the diaphragm pump through the inlet port, wherein the terminating the electrical signal to the diaphragm pump results in the bending of the diaphragm pump toward the concave surface, thereby pushing fluid from the diaphragm pump through the outlet port, through the outlet duct, and though the third one-way valve to the external aspect of the device.

20. A method for dispensing a fluid comprising:

connecting a pod to a dispenser;

depressing a button disposed on the dispenser;

sensing orientation of the dispenser, wherein the sensing step determines if the orientation of the dispenser is upright, or not upright;

sending an electrical signal from the pod to actuate an intake stroke when the orientation of the dispenser is determined to be upright;

actuating the intake stroke of a diaphragm pump resulting in drawing the fluid from a reservoir, and into the diaphragm pump;

terminating the electrical signal resulting in actuating an ejection stroke of the diaphragm pump;

ejecting the fluid from the diaphragm pump through an outlet; and dispensing the fluid from the pod.

21. The method of claim 20, further comprising steps of:

setting a preferred dose on a dispenser; and saving the preferred dose amount to a controller, wherein the setting step and saving steps are performed prior to the depressing step.

22. The method of claim 21, further comprising steps of:

reading pod information from the pod, and saving the pod information to the dispenser; and communicating wirelessly the pod information from the dispenser to a connected computing device, wherein the reading step and communicating steps are performed following the connecting step.

23. The method of claim 22, further comprising steps of:

recording dispensed amount and time of dispensing to the dispenser;

recording remaining amount of fluid to the pod; and displaying the remaining amount of fluid remaining, wherein the recording dispensed amount step, the recording remaining amount step, and the displaying steps are performed following the dispensing step.

24. The method of claim 23, wherein the reading step further comprises reading max dosage information comprising a max dosage within a predetermined time period, and saving the max dosage to the dispenser.

25. The method of claim 24, further comprising a comparing step prior to the sending electrical signal step, wherein the comparing step compares the recorded dispensed amount in the predetermined time period prior to the sending electrical signal step with the max dosage, and wherein if the recorded dispensed amount within the predetermined time period prior to the sending electrical signal step is equal or greater than the max dosage, the dispenser will not perform the sending electrical signal step.

* * * * *